US007783230B2

(12) United States Patent
Ju et al.

(10) Patent No.: US 7,783,230 B2
(45) Date of Patent: Aug. 24, 2010

(54) TRANSFER UNIT, IMAGE FORMING APPARATUS HAVING THE SAME, AND METHOD THEREOF

(75) Inventors: Jeong-yong Ju, Suwon-si (KR); Il-kwon Kang, Suwon-si (KR); Gyeong-sun Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 535 days.

(21) Appl. No.: 11/750,063

(22) Filed: May 17, 2007

(65) Prior Publication Data

US 2008/0138111 A1 Jun. 12, 2008

(30) Foreign Application Priority Data

Dec. 7, 2006 (KR) ..... 10-2006-0123794

(51) Int. Cl.
*G03G 15/08* (2006.01)

(52) U.S. Cl. ..... 399/121

(58) Field of Classification Search ..... 399/107, 399/110, 121, 124

See application file for complete search history.

(56) References Cited

U.S. PATENT DOCUMENTS 5,802,426 A 9/1998 Miyazaki et al.
2004/0190934 A1 9/2004 Okabe

FOREIGN PATENT DOCUMENTS

EP 1321829 6/2003
JP 2001-2330 1/2001

OTHER PUBLICATIONS

European Search Report issued Apr. 14, 2008 in EP 7113272.

*Primary Examiner*—Hoang Ngo
(74) *Attorney, Agent, or Firm*—Stanzione & Kim, LLP

(57) ABSTRACT

A transfer unit and an image forming apparatus having the same. The transfer unit includes a transfer unit body to accommodate a printing medium conveyor, which makes a printing medium receive an image while moving the printing medium, a body handle used to mount the transfer unit body in an image forming apparatus and to separate the transfer unit body from the image forming apparatus, and a locking and releasing unit to lock the transfer unit body to the image forming apparatus and to release a locking connection therebetween. The locking and releasing unit is disposed to carry out a releasing operation by grasping the body handle.

22 Claims, 7 Drawing Sheets

TRANSFER UNIT, IMAGE FORMING APPARATUS HAVING THE SAME, AND METHOD THEREOF

CROSS-REFERENCE TO RELATED APPLICATIONS

This application claims priority under 35 U.S.C. §119(a) from Korean Patent Application No. 10-2006-123794, filed on Dec. 7, 2006, in the Korean Intellectual Property Office, the entire content of which is incorporated herein in its entirety by reference.

BACKGROUND OF THE INVENTION

1. Field of the Invention

The present general inventive concept relates to an image forming apparatus. More particularly, the present general inventive concept relates to a transfer unit, which receives an image formed by a developing unit and transfers the image onto a printing medium, an image forming apparatus having the same, and a method thereof.

2. Description of the Related Art

A conventional image forming apparatus can be classified into a mono image forming apparatus to form an image using only black and white, and a color image forming apparatus to form an image using a plurality of colors. Also, according to a developing method, the image forming apparatus can be classified into an inkjet image forming apparatus and an electrophotographic image forming apparatus.

Among the image forming apparatuses as described above, the electrophotographic image forming apparatus is provided with a photoconductive medium, such as a photoconductive drum, a photoconductive belt or the like, a laser scanning unit to scan a laser beam onto the photoconductive medium to form an electrostatic latent image corresponding to a desired image, and a developing unit to develop the electrostatic latent image with a developer, such as a toner.

The image formed on the photoconductive medium can be transferred onto a printing medium through a transfer unit, or directly onto the printing medium. Namely, in a color electrophotographic image forming apparatus, color images which are formed on a single photoconductive medium or a plurality of photoconductive media are transferred in an overlapping manner onto a transfer medium, such as an intermediate transfer belt or the like, of the transfer unit, and then the overlapped color images are transferred onto the printing medium. In a mono electrophotographic image forming apparatus, an image formed on a photoconductive medium is directly transferred onto the printing medium.

The transfer unit includes a transfer medium, such the intermediate transfer belt or the like, a plurality of rollers, and a transfer unit body to accommodate the rollers and the transfer medium. The transfer unit having the construction as described above is mounted in an apparatus body, so that the transfer medium comes in contact with the photoconductive media. To mount or separate the transfer unit in or from the apparatus body, the transfer unit body has more than one handle formed thereon. During mounting, the transfer unit body is pushed into the apparatus body while being slid in the apparatus body, and during separating, the transfer unit body is separated from the apparatus body after a cover of the image forming apparatus is opened. However, to mount or separate the transfer unit in or from the apparatus body as described above, the conventional image forming apparatus is inconvenient in that a user is required to separately lock the transfer unit to the apparatus body or release a locking connection of the transfer unit to the apparatus body. For example, to separate the transfer unit, the user should manipulate a locking-releasing button or lever installed on a certain position, and then separate the transfer unit from the apparatus body while grasping the handle of the transfer unit body with the user's hand.

SUMMARY OF THE INVENTION

The present general inventive concept provides a transfer unit having an improved structure to easily mount in and separate from an apparatus body, an image forming apparatus having the transfer unit, and a method thereof.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a transfer unit, including a transfer unit body to accommodate a printing medium conveyor to allow a printing medium to receive an image while moving the printing medium thereon, a body handle to mount the transfer unit body in an image forming apparatus and to separate the transfer unit body from the image forming apparatus, and a locking and releasing unit to lock the transfer unit body to the image forming apparatus and to release a locking connection therebetween. The locking and releasing unit is formed to carry out a releasing operation by grasping the body handle.

The locking and releasing unit may include a manipulating handle movably disposed to the body handle, a rotating member rotatably disposed on the transfer unit body to support the body handle, at least one hook member connected to the rotating member to be locked to and released from the image forming apparatus according to a rotated position, and a pressing member to press the rotating member to a position where the rotating member allows the hook member lock to the image forming apparatus.

The body handle may be recessed at a predetermined depth from an area outside of the transfer unit body.

The manipulating handle may be movably accommodated in the body handle.

The hook member may be configured, so that a pair of hook members is connected to both ends of the rotating member, respectively.

The transfer unit body may be openably mounted on a cover of the image forming apparatus.

The transfer unit body has at least one guide part to couple the transfer unit body to the cover.

The foregoing and/or other aspects and utilities of the present general inventive concept may also be achieved by providing an image forming apparatus, including an apparatus body, and a transfer unit disposed to be lockable to and releasable from the apparatus body. A locking connection between the transfer unit and the apparatus body may be released by grasping a handle disposed to the transfer unit to separate the transfer unit.

The transfer unit may include a transfer unit body to accommodate a printing medium conveyor to convey a printing medium receiving an image, a handle body disposed on the transfer unit body, and a locking and releasing unit to lock the transfer unit body to and from the apparatus body and to release a locking connection therebetween.

The apparatus body may include a main casing, and a cover unit openably installed to the main casing to mount the transfer unit thereon.

The cover unit may include at least one guide member rotatably disposed on the main casing to guide and support a mounting position of the transfer unit, and a cover body rotatably disposed to the main casing and having at least one locking protrusion to which the transfer unit is locked.

The printing medium conveyor may include a conveying belt to move while facing at least one photoconductive medium, which forms an image.

The foregoing and/or other aspects and utilities of the present general inventive concept may also be achieved by providing an image forming apparatus, including an apparatus body, a transfer unit detachably coupled to the apparatus body to allow a printing medium to receive an image while moving thereon; a locking and releasing unit to allow the transfer unit to attach to and detach from the apparatus body, and a manipulating handle disposed on the transfer unit to control the locking and releasing unit.

The locking and releasing unit may include a rotating member rotatably disposed on the transfer unit, and at least one hook member connected to the rotating member to be locked to and released from the apparatus body according to a rotated position.

The locking and releasing unit may further include a pressing member to press the rotating member to a position where the rotating member makes the at least one hook member lock to the apparatus body.

The attaching and the detaching may be controlled by a grasping of the manipulating handle.

The foregoing and/or other aspects and utilities of the present general inventive concept may also be achieved by providing a method of locking a transfer unit body to or releasing a transfer unit body from a cover unit of an image forming apparatus, the method including moving a printing medium along a printing medium conveyor to allow the printing medium to receive an image, mounting the transfer unit body in an image forming apparatus; separating the transfer unit body from the image forming apparatus, and locking the transfer unit body to the image forming apparatus or releasing a locking connection therebetween.

The foregoing and/or other aspects and utilities of the present general inventive concept may also be achieved by providing a transfer unit usable with an image forming apparatus, including a transfer unit body having a printing medium conveyor, a guide element formed on a lower end of the transfer unit body, a handle formed on an upper end of the transfer unit body, and a locking and releasing unit moveably formed on a middle portion of the transfer unit body between the guide element and the handle to move the transfer unit body with respect to the guide element according to a manipulation of the handle.

The foregoing and/or other aspects and utilities of the present general inventive concept may also be achieved by providing an image forming apparatus, including an apparatus body having a developing unit, a cover rotatably connected to the apparatus body, and a transfer unit including a transfer unit body having a printing medium conveyor, a guide element formed on a lower end of the transfer unit body, a handle formed on an upper end of the transfer unit body, and a locking and releasing unit moveably formed on a middle portion of the transfer unit body between the guide element and the handle to move the transfer unit body with respect to the guide element according to a manipulation of the handle.

The transfer unit may be installed in the apparatus body, the transfer unit may be disposed on the cover in a first position, may move toward the cover in a second position to be attached to the cover according to a movement of the locking and releasing unit, and may move toward the developing unit of the apparatus body in a third position together with the cover.

The transfer unit may be uninstalled from the apparatus body, the transfer unit may move away from the apparatus body together with the cover from a closed position to an open position, may move away from the cover from the open position to a middle position according to a movement of the guide element, and may be detached from the cover.

BRIEF DESCRIPTION OF THE DRAWINGS

These and/or other aspects and utilities of the present general inventive concept will become apparent and more readily appreciated from the following description of the exemplary embodiment, taken in conjunction with the accompanying drawings of which.

DETAILED DESCRIPTION OF THE PREFERRED EMBODIMENTS

Figure 1:
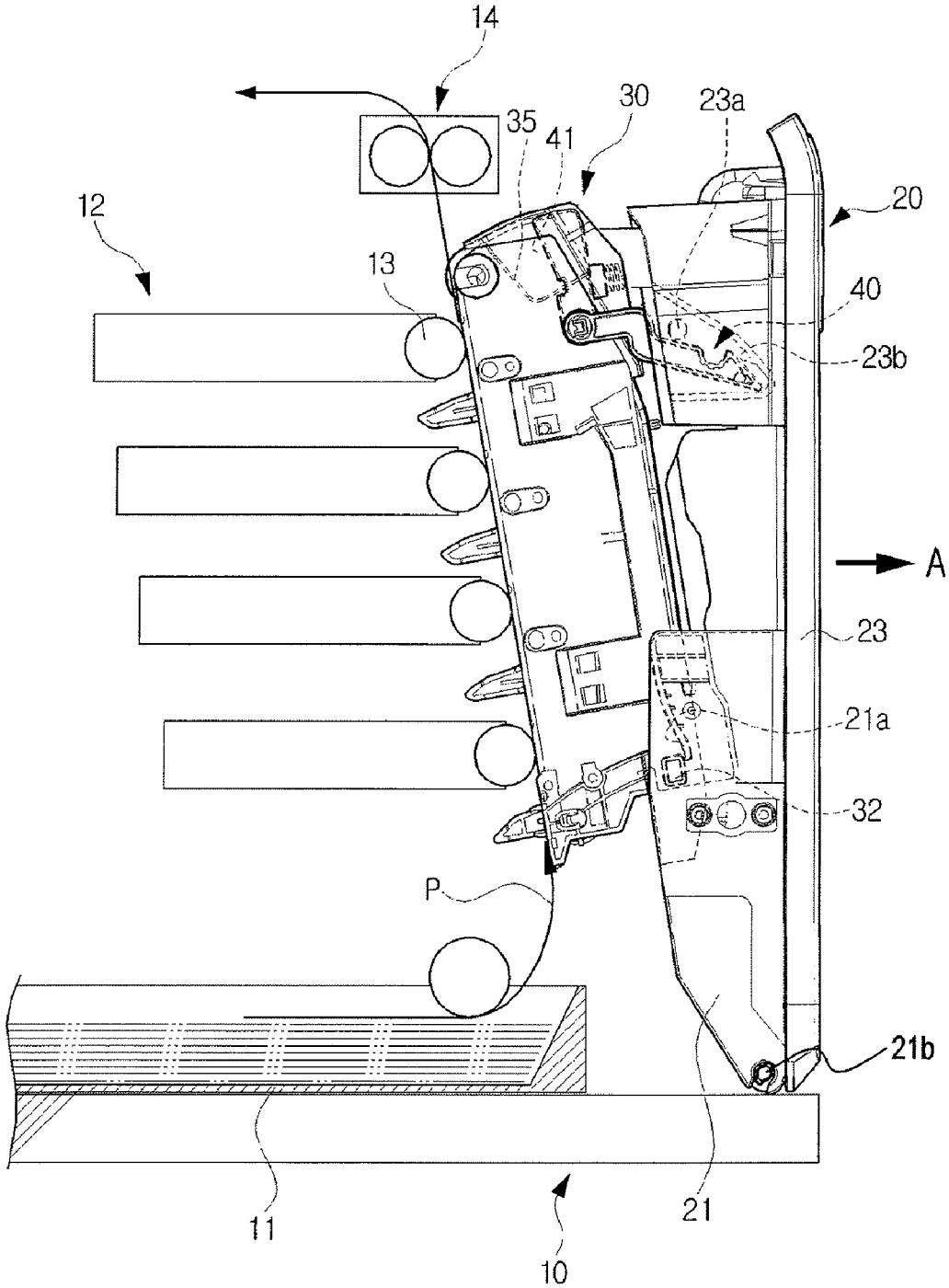
FIG. 1 is a schematic view illustrating a construction of an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Referring to FIG. 1, the image forming apparatus is provided with an apparatus body 10, a cover unit 20 which is openably disposed on a side of the apparatus body 10, a transfer unit 30 which is mountable on or separable from the cover unit 20, and a locking and releasing unit 40. A medium cassette 11, which supplies a printing medium (referred to as a paper P below), is disposed in a lower part of the apparatus body 10. A plurality of developing units 12, which form images according to a plurality of colors, for example, black K, cyan, C, magenta M, and yellow Y, are disposed in the apparatus body 10. The developing units 12 are arranged so that they receive toner particles from corresponding developing rollers by using and applying electric change differences on electrostatic latent images which are formed on photoconductive media 13 to form certain images thereon, respectively.

Each of the photoconductive media 13 is formed in a drum shape. The electrostatic latent images, which correspond to a desired image, are formed on surfaces of the photoconductive media 13 by laser beams which are scanned from a laser scanning unit (not illustrated), respectively.

Also, the images (i.e., color images or black-and-white images) which are formed on the photoconductive media 13 are directly transferred onto the paper P, which is conveyed between the photoconductive medium 13 and the transfer unit 30. The paper P on which the images are transferred, as described above, has images fixed thereon with heat and pressure while the paper P passes through a fixing unit 14. The paper P subsequently discharges to an area outside of the image forming apparatus or moves into a duplex passage to perform duplex printing.

The cover unit 20 is provided with guide members 21 and a cover body 23. The guide members 21 guide mounting and separating movements of the transfer unit 30 to and from the cover unit 20. The cover body 23 at an end thereof is rotatably connected on the apparatus body 10 by a rotating axis shaft 21*b*.

Figure 2:
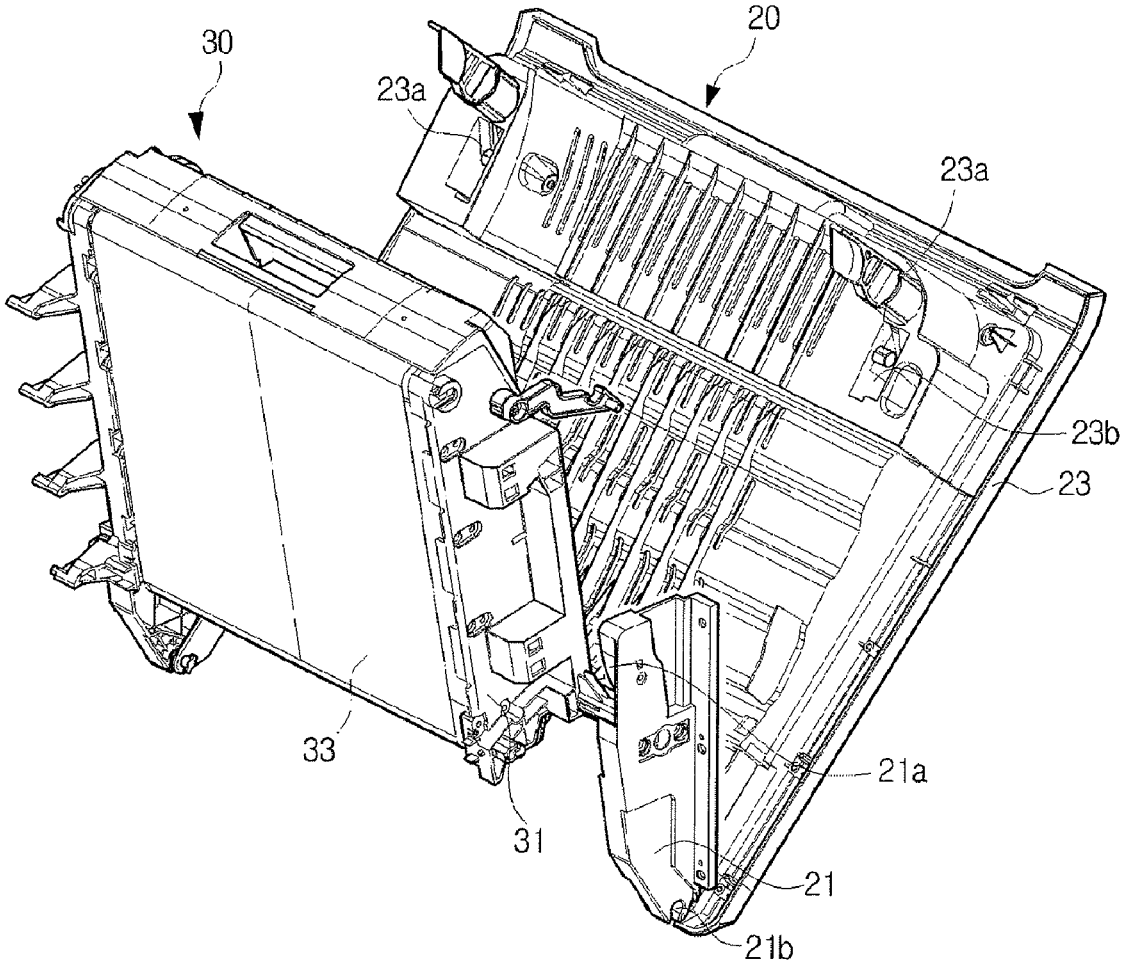
FIG. 2 is a perspective view illustrating a cover unit and a transfer unit of the image forming apparatus illustrated in FIG. 1.

The guide members 21 at ends thereof are also rotatably connected to the apparatus body 10, so that they can rotate together with the cover body 23 with respect to the apparatus body 10. As illustrated in FIG. 2, the guide members 21 are configured, to allow a pair of guide members to support both side surfaces of the transfer unit 30. Each of the guide members 21 has a guide part 21*a*, which guides mounting and separating positions of the transfer unit 30. The guide members 21 are installed to share the rotating axis or shaft 21*b* thereof with the cover body 23. Accordingly, the guide members 21 can be rotated at a first angle together with the cover body 23, or rotated with respect to the cover body 23 at a second angle to be separated from the cover body 23.

The cover body 23, which supports the transfer unit 30, is installed on the apparatus body 10 to rotate at a certain angle to open or close. Accordingly, the cover body 23 can be opened by a user when the transfer unit 30 is mounted in or separated from the apparatus body 10. In addition, the duplex passage can be provided between the cover body 23 and the transfer unit 30. Also, to remove a paper jam between the transfer unit 30 and the photoconductive media 13, the cover body 23 can be opened. The cover body 23 has a pair of locking protrusions 23*a*, which can perform a locking operation of the locking and releasing unit 40. The locking protrusions 23*a* are formed in locking grooves 23*b* which are dug in a surface of the cover body 23, which faces the transfer unit 30.

Figure 3:
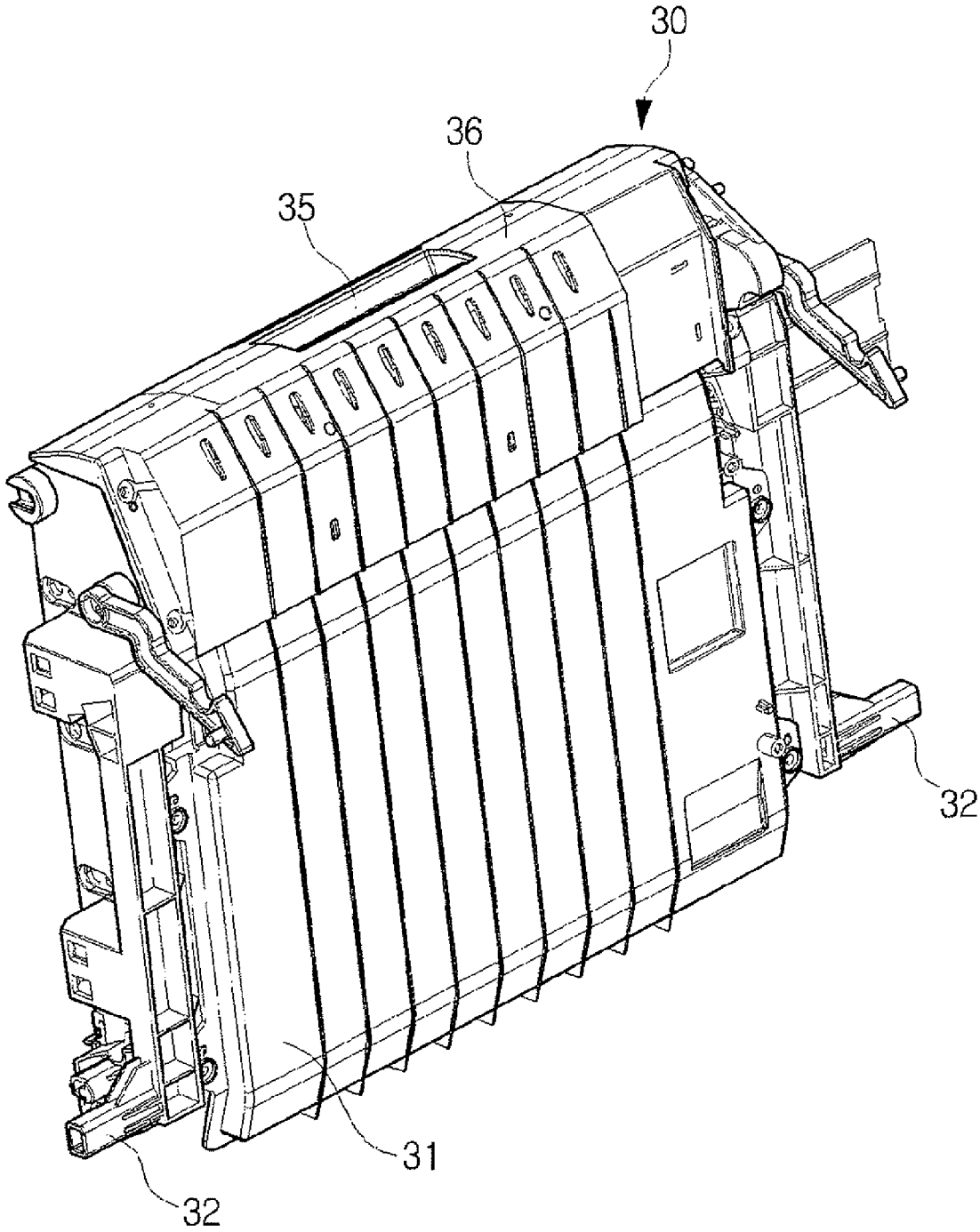
FIG. 3 is a perspective view illustrating the transfer unit illustrated in FIG. 2.

The transfer unit 30 is detachably installed in the apparatus body 10 and is supported on the cover unit 20. The transfer unit 30 can be mounted on the cover body 23 through the guide members 21. The transfer unit 30 can move together with the guide members 21 toward the cover body 23 by an angle with respect to the rotating axis 21*b* to be mounted on the cover body 23, and then move together with the cover body 23 toward the photoconductive member 13 to be mounted on the apparatus body 10 by another angle. The another angle is greater than the angle. As illustrated in FIGS. 2 and 3, the transfer unit 30 is provided with a transfer unit body 31 and a printing medium conveyor 33 which is disposed in the transfer unit body 31.

Guide protrusions (or guide elements) 32, which are supported by the guide member 21 of the cover unit 20, are formed on both sides of a lower end of the transfer unit body 31, respectively. As illustrated in FIGS. 1 and 2, the guide protrusions 32 are inserted into and supported by the guide part 21*a* of the guide members 21.

Figure 4:
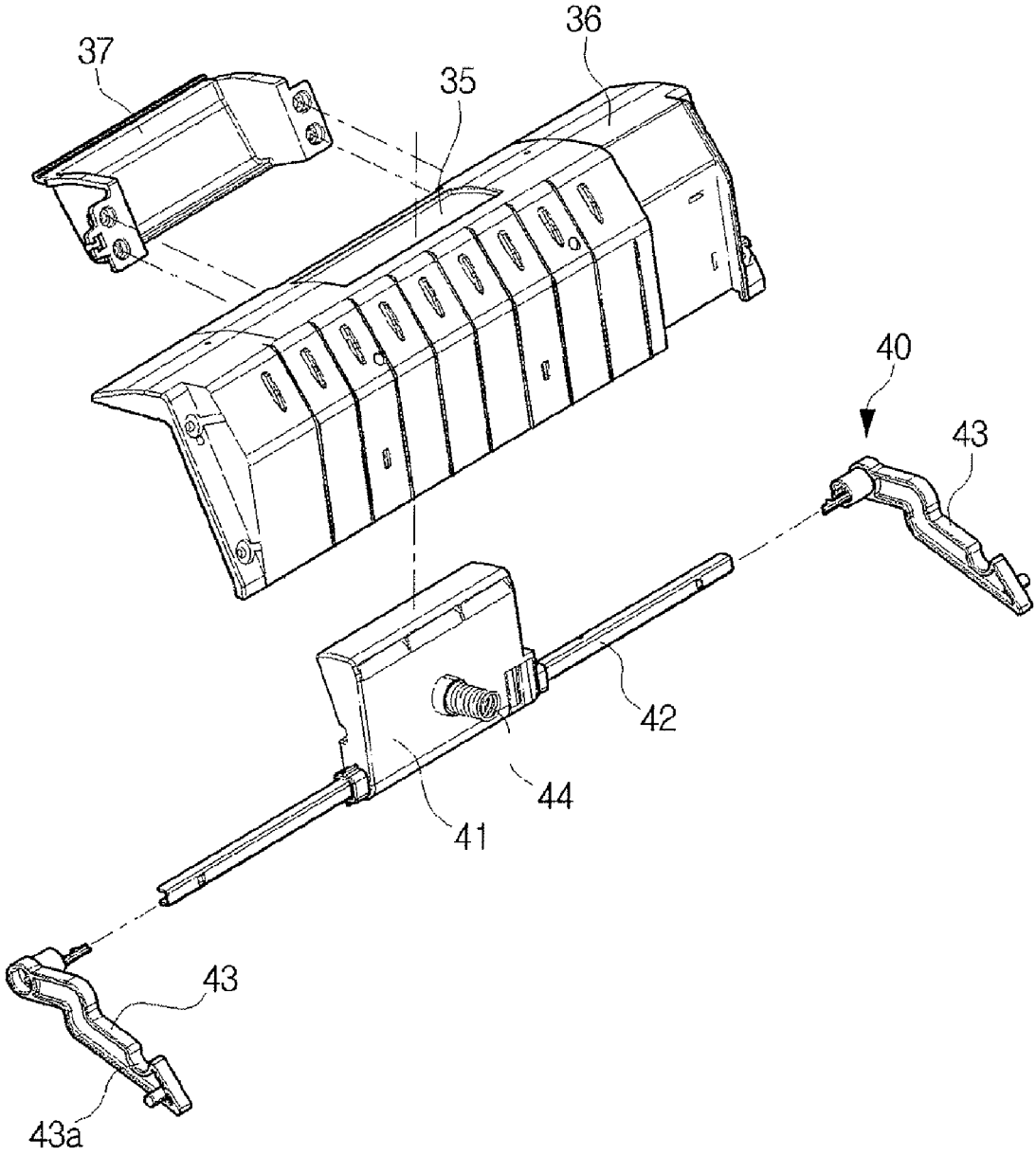
FIG. 4 is an exploded perspective view illustrating a locking and releasing unit of the transfer unit illustrated in FIG. 3.

Also, a body handle 35 is formed on the transfer unit body 31. Referring to FIG. 4, the body handle 35 has a shape which is dug or recessed at a predetermined depth to attach to an upper end of the transfer unit body 31. The body handle 35 having the above-mentioned shape is formed by a handle cover 36 and a handle bracket 37, which are joined to the transfer unit body 31. More specifically, the handle bracket 37 is coupled top an inner wall surface of the handle cover 36, and allows the body handle 35 to attach to the transfer unit body 31. Furthermore, the handle cover 36 has a hole which allows a user to grasp the body handle 35.

The printing medium conveyor 33 is a conveying belt, which is disposed on and movably supported by a plurality of supporting rollers (not illustrated) in the transfer unit body 31. The printing medium conveyor 33, as described above, is arranged so that a portion, which approximately corresponds to a horizontal traveling section, is exposed to an area outside the transfer unit body 31. As illustrated in FIG. 1, the exposed portion of the printing medium conveyor 33 comes in contact with the photoconductive media 13. Accordingly, when the printing medium conveyor 33 moves, the paper P, which is supplied between the printing medium conveyor 33 and the photoconductive media 13, receives the images from the photoconductive media 13 while moving along the printing medium conveyor 33.

Transporting, mounting and separating operations of the transfer unit 30, which is constructed as described above, can be carried out when the body handle 35 is grasped by a user's hand.

The locking and releasing unit 40 locks the transfer unit 30 to the apparatus body 10, through, for example, the cover unit 20, and releases a locking connection between the transfer unit 30 and the cover unit 20. As illustrated in FIGS. 1 through 4, the locking and releasing unit 40 is provided with a manipulating handle 41 which is movably disposed with reference to the body handle 35, a rotating member 42 which is rotatably disposed in the transfer unit body 31 to support the manipulating handle 41, hook members 43 which are connected to both ends of the rotating member 42, and a pressing member 44. When the handle bracket 37 is attached to the handle cover 36 to form a space therebetween, the manipulating handle 41 is inserted into the space between the handle bracket 37 and the handle cover 36 to correspond to the handle cover 36 so that a user grasps the body handle 35 and a top portion of the manipulating handle 41.

The manipulating handle 41 is movably disposed in the body handle 35 of the transfer unit body 31. Accordingly, if the user inserts a hand into the body handle 35 and grasps the body handle 35 with the hand, the manipulating handle 41 can be seized together with the body handle 35.

The manipulating handle 41 is connected to an approximate middle portion of the rotating member 42. The rotating member 42 acts as a rotating axis of the manipulating handle 41.

Figure 5:
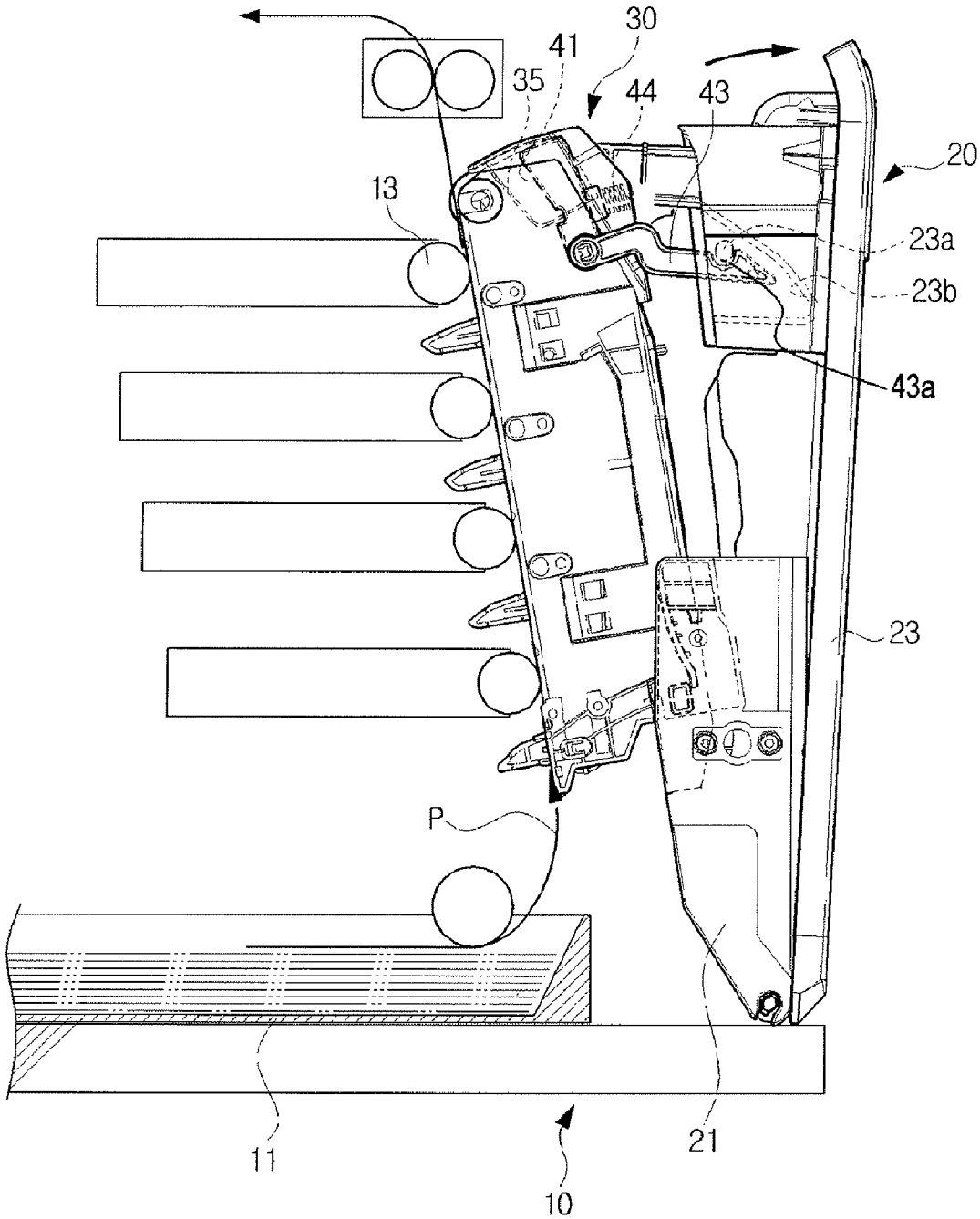
FIGS. 5, 6 and 7 are views illustrating an operation, which separates the transfer unit from the cover unit.

The hook members 43 are connected to both ends of the rotating member 42, respectively. The hook members 43 are projected toward the cover unit 20 at both sides of the transfer unit 30, respectively. The hook members 43 can rotate together with the rotating member 42. The hook members 43 can rotate with respect to the transfer unit 30. The hook members 43 are provided with hook grooves 43*a*, which hang on the locking protrusions 23*a* which are formed on the cover body 23, respectively. As illustrated in FIG. 5, the hook grooves 43*a* of the hook members 43 are inserted in the locking grooves 23*b* of the cover body 23, and are attached to the locking protrusions 23*a*.

One end of the pressing member (elastic member) 44 comes in contact with the manipulating handle 41, and another end of the pressing member 44 comes in contact with the handle cover 36. The pressing member 44 is disposed between the handle cover 36 and the manipulating handle 41 to bias the manipulating handle 41 away from the handle cover 36. The pressing member 44 presses the manipulating handle 41 in one direction (e.g., a counterclockwise direction as illustrated in FIG. 5), so that the hook members 43 are coupled to the locking protrusions 23*a*.

Hereinafter, an operation of separating the transfer unit 30 of the image forming apparatus with respect to the apparatus body 10 according to an exemplary embodiment of the present general inventive concept which is constructed as described above.

As illustrated in FIG. 1, the transfer unit 30 is mounted in the apparatus body 10. Namely, the transfer unit 30 is in the state where a lower end thereof is supported by the guide member 21 of the cover unit 20, and an upper end thereof is pushed by the cover unit 20 and is thus supported between the developing units 12 and the cover unit 20. Also, when the cover unit 20 is closed with reference to the apparatus body 10, the cover body 23 of the cover unit 20 supports the transfer unit 30 to come in close contact with the developer units 12 to transfer an image to the paper P disposed therebetween.

Accordingly, if a user wants to separate the transfer unit 30 from the apparatus body 10, the user opens the cover unit 20 in a direction of arrow A.

As illustrated in FIG. 5, only the cover body 23 of the cover unit 20 is rotated at a certain angle in order to be opened. Accordingly, the transfer unit 30 may be continuously in contact with the photoconductive medium 13 with a lower end thereof supported by the guide member 21. Also, the hook members 43 of the transfer unit 30 are rotated by a pressing force of the pressing member 44, and are thus hung on the locking protrusions 23*a*.

Figure 6:
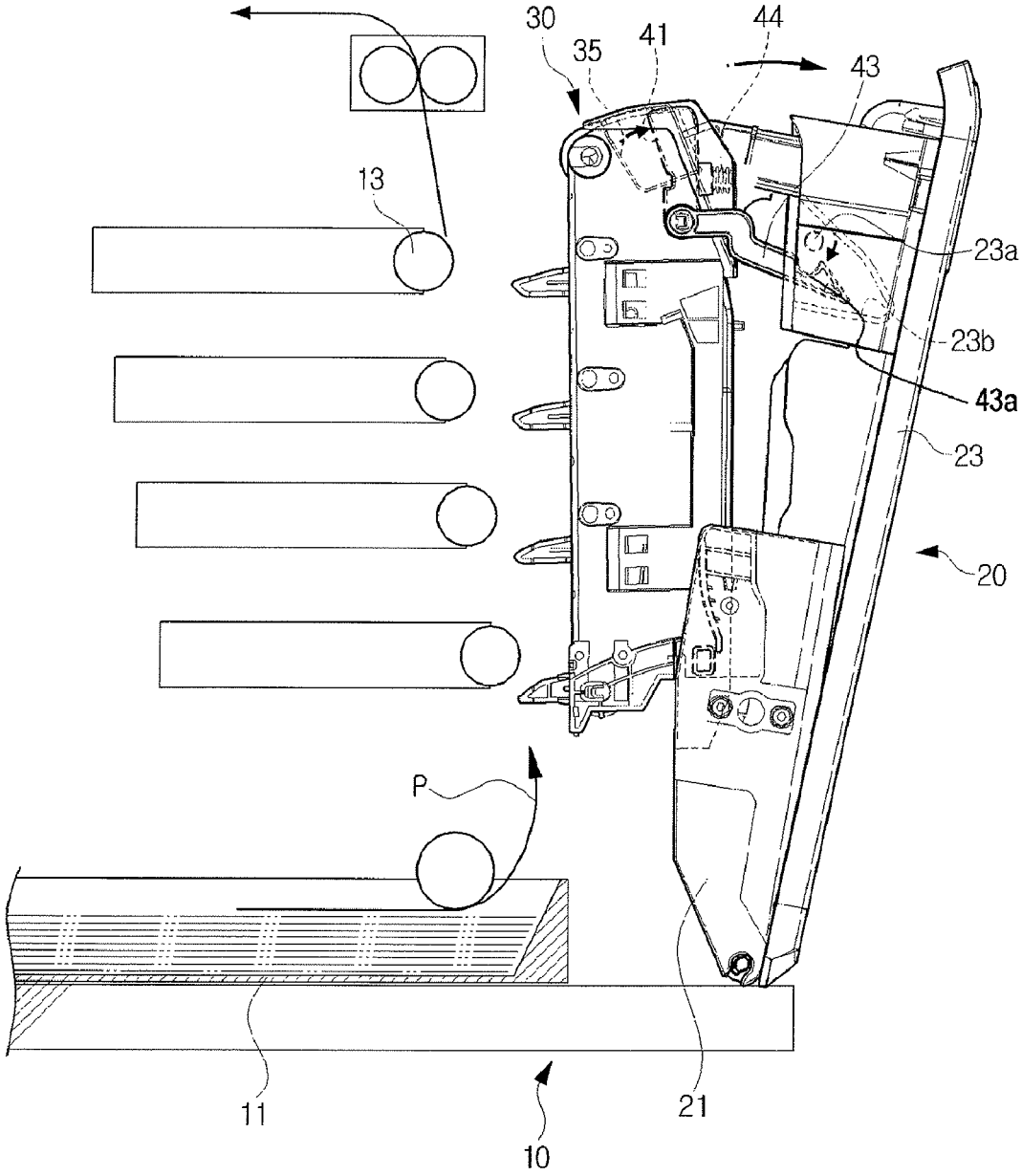

As illustrated in FIG. 5, when the cover unit 20 is further opened by another angle, the transfer unit 30 is led by the cover unit 20 to rotate along therewith, and is departed from the photoconductive media 13, as further illustrated in FIG. 6. Accordingly, since the hook members 43 are hung on the locking protrusions 23*a*, the transfer unit 30 is led by the cover unit 20 and is rotated along with the cover unit 20.

Figure 7:
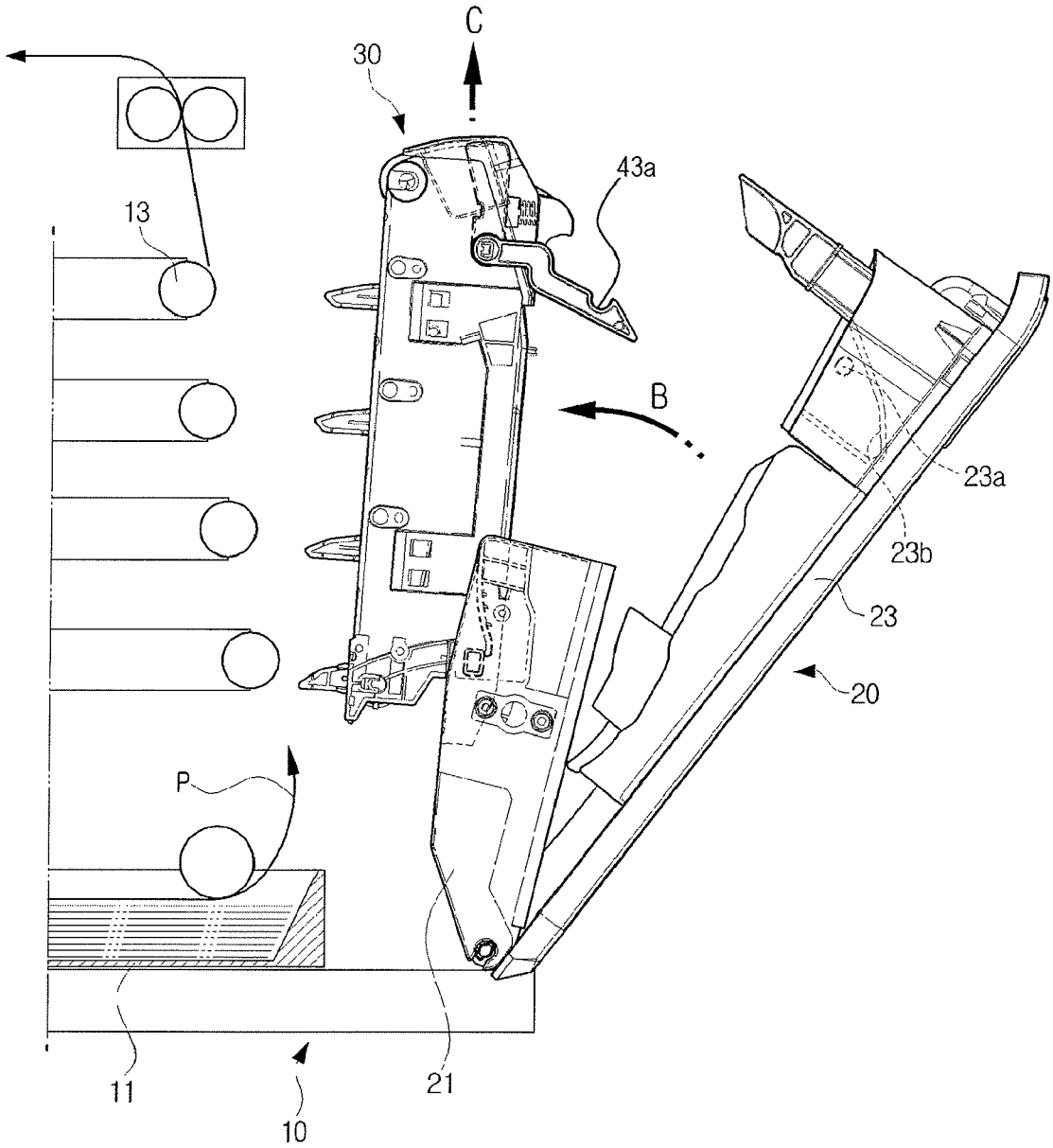

As illustrated in FIG. 6, the user can insert a hand into the body handle 35 in order to grasp the manipulating handle 41 and the transfer unit body 20 (that is, the entire handle cover 36). Then, the manipulating handle 41 can be rotated with respect to the rotating member 42 by the user's grasping force against a pressing (elastic) force of the pressing member 33, so that the hook members 43 release a locking connection of the locking protrusions 23*a*. As illustrated in FIG. 7, if the transfer unit 30 is moved together with the guide members 21 in a direction of arrow B by another angle, it is released from the cover body 23 and is thus completely separated from the cover body 23. When the transfer unit 30 which is separated from the cover body 23 as described above is lifted in an upward direction, that is, a direction of arrow C with the body handle 35 being grasped by the user, it is completely separated from the guide member 21.

In the foregoing description, although only the operation of separating the transfer unit has been explained, an operation of mounting the transfer unit is carried out in a reverse order to the operation of separating the transfer unit. Accordingly, first, the transfer unit 30 is placed and seated on the guide member 21 with the body handle 35 and the manipulating handle 41 being grasped together. Then, when the transfer unit 30 is rotated to move toward the cover body 23, it is locked to and supported by the cover body 23, as illustrated in FIG. 6. Accordingly, when the cover unit 20 is closed, the transfer unit 30 and the cover unit 20 are joined with each other in an order as illustrated in FIGS. 5 and 1.

According to the image forming apparatus of the exemplary embodiment of the present general inventive concept as described above, the locking and releasing unit 40 to lock a connection and separation between the transfer unit 30 and the cover unit 20 is configured, so that the locking and releasing unit 40 operates by grasping the body handle 35 of the transfer unit 30, thereby allowing the transfer unit 30 to easily and conveniently mount to and separate from the cover unit. Accordingly, when the cover unit 20 is opened, if the body handle 35 of the transfer unit 30 is grasped only once, the locking connection between the transfer unit 30 and the cover unit 20 can be released at the same time as when the released transfer unit 30 is separated from the cover unit 20. Accordingly, there is no need to separately carry out two separate operations of releasing the locking connection between the transfer unit and the cover unit and separating the released transfer unit, as in the conventional image forming apparatus.

As apparent from the foregoing description, according to an exemplary embodiment of the present general inventive concept, a transfer unit and an image forming apparatus having the same are configured, so that the transfer unit releases a locking connection to a cover unit, that is, an apparatus body, by grasping a body handle of the transfer unit. Accordingly, during separation of the transfer unit, a locking connection between the transfer unit and the cover unit can be automatically released by grasping the body handle of the transfer unit only once, and the released transfer unit can be simply separated from the cover unit by raising the grasped body handle.

Thus, since the operations of separating and mounting the transfer unit are simplified, a user can safely and conveniently handle the transfer unit.

Also, the transfer unit and the image forming apparatus having the same according to the exemplary embodiment of the present general inventive concept are configured, so that the transfer unit is mounted to be joined with the cover unit. Accordingly, the transfer unit and the image forming apparatus having the same according to the exemplary embodiment of the present general inventive concept are advantageous in that the transfer unit is accurately positioned to the developing units.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A transfer unit usable with an image forming apparatus, comprising:

a transfer unit body mounted on a cover openably installed to the image forming apparatus to accommodate a printing medium conveyor to allow a printing medium to receive an image while moving the printing medium thereon;

a body handle to mount the transfer unit body in an image forming apparatus and to separate the transfer unit body from the image forming apparatus; and a locking and releasing unit to lock the transfer unit body to the image forming apparatus and to release a locking connection therebetween, wherein the locking and releasing unit is formed to carry out a releasing operation by grasping the body handle, and the transfer unit body is separated from the cover by lifting up the body handle.

2. The unit of claim 1, wherein the locking and releasing unit comprises:

a manipulating handle movably disposed to the body handle;

a rotating member rotatably disposed on the transfer unit body to support the body handle;

at least one hook member connected to the rotating member to be locked to and released from the image forming apparatus according to a rotated position; and a pressing member to press the rotating member to a position where the rotating member allows the hook member lock to the image forming apparatus.

3. The unit of claim 2, wherein the body handle is recessed at a predetermined depth from an outside area of the transfer unit body.

4. The unit of claim 3, wherein the manipulating handle is movably accommodated in the body handle.

5. The unit of claim 2, wherein the hook member comprises a pair of hook members connected to both ends of the rotating member, respectively.

6. The unit of claim 1, wherein the transfer unit body is openably mounted on the cover of the image forming apparatus.

7. The unit of claim 6, wherein the transfer unit body comprises at least one guide member to couple the transfer unit body to the cover.

8. An image forming apparatus, comprising:

an image forming apparatus body having an openable cover; and a transfer unit disposed to be lockable to and releasable from the image forming apparatus body, wherein a locking connection between the transfer unit and the cover is released by grasping a body handle to separate the transfer unit.

9. The apparatus of claim 8, wherein the transfer unit comprises:

a transfer unit body to accommodate a printing medium conveyor to convey a printing medium receiving an image; and a locking and releasing unit to lock the transfer unit body to the apparatus body and to release a locking connection therebetween, wherein the body handle is disposed on the transfer unit body.

10. The apparatus of claim 9, wherein the locking and releasing unit comprises:

a manipulating handle movably disposed on the body handle;

a rotating member rotatably disposed on the transfer unit body to support the body handle;

at least one hook member connected to the rotating member to be locked to and released from the apparatus body according to a rotated position; and a pressing member to press the rotating member to a position where the rotating member makes the hook member lock to the apparatus body.

11. The apparatus of claim 10, wherein the body handle is recessed at a predetermined depth from an area outside of the transfer unit body.

12. The apparatus of claim 11, wherein the manipulating handle is movably accommodated in the body handle.

13. The apparatus of claim 10, wherein a pair of hook members is connected to both ends of the rotating member, respectively.

14. The apparatus of claim 8, wherein the cover comprises:

at least one guide member rotatably disposed on the main casing to guide and support a mounting position of the transfer unit; and a cover body rotatably disposed to the main casing and having at least one locking protrusion to which the transfer unit is locked.

15. The apparatus of claim 9, wherein the printing medium conveyor comprises:

a conveying belt to move while facing at least one photoconductive medium, which forms an image.

16. An image forming apparatus, comprising:

an apparatus body having a cover;

a transfer unit detachably coupled to the cover to allow a printing medium to receive an image while moving thereon;

a locking and releasing unit to allow the transfer unit to attach to and detach from the apparatus body; and a manipulating handle disposed on the transfer unit to control the locking and releasing unit by grasping the handle, wherein the transfer unit is separated from the cover by grasping and lifting up the manipulating handle.

17. The image forming apparatus of claim 16, wherein the locking and releasing unit comprises:

a rotating member rotatably disposed on the transfer unit; and at least one hook member connected to the rotating member to be locked to and released from the apparatus body according to a rotated position.

18. The image forming apparatus of claim 17, wherein the locking and releasing unit further comprises:

a pressing member to press the rotating member to a position where the rotating member makes the at least one hook member lock to the apparatus body.

19. The image forming apparatus of claim 16, wherein the attaching and the detaching is controlled by a grasping of the manipulating handle.

20. A method of locking a transfer unit body to or releasing a transfer unit body from a cover of an image forming apparatus, the method comprising:

moving a printing medium along a printing medium conveyor to allow the printing medium to receive an image;

mounting the transfer unit body in the cover by pushing the transfer unit body towards the cover;

closing the cover to the image forming apparatus;

opening the cover from the image forming apparatus;

separating the transfer unit body from the cover by grasping a transfer unit body handle.

21. A transfer unit usable with an image forming apparatus, comprising:

a transfer unit body having a printing medium conveyor and disposed on a cover which is openably installed to the image forming apparatus;

a guide element formed on a lower end of the transfer unit body;

a handle formed on an upper end of the transfer unit body; and a locking and releasing unit moveably formed on a middle portion of the transfer unit body between the guide element and the handle to move the transfer unit body with respect to the guide element according to a grasping of the handle, wherein the transfer unit body is separated from the cover by a lifting up operation.

22. An image forming apparatus, comprising:

an apparatus body having a developing unit;

a cover rotatably connected to the apparatus body; and a transfer unit comprising:

a transfer unit body having a printing medium conveyor, a guide element formed on a lower end of the transfer unit body, a handle formed on an upper end of the transfer unit body, and a locking and releasing unit moveably formed on a middle portion of the transfer unit body between the guide element and the handle to move the transfer unit body with respect to the guide element according to a grasping of the handle, wherein when the transfer unit is installed in the apparatus body, the transfer unit is disposed on the cover in a first position, moves toward the cover in a second position to be attached to the cover according to a movement of the locking and releasing unit, and moves toward the developing unit of the apparatus body in a third position together with the cover, wherein when the transfer unit is uninstalled from the apparatus body, the transfer unit moves away from the apparatus body together with the cover from a closed position to an open position, moves away from the cover from the open position to a middle position according to a movement of the guide element by grasping, and is separated from the cover by lifting up the handle.

* * * * *